United States Patent [19]

Kronich

[11] Patent Number: 4,896,634

[45] Date of Patent: Jan. 30, 1990

[54] PHASE TIMED CAMSHAFT SPRAY LUBRICATION SYSTEM

[75] Inventor: Peter G. Kronich, Sheboygan, Wis.

[73] Assignee: Tecumseh Products Company, Tecumseh, Mich.

[21] Appl. No.: 361,565

[22] Filed: Jun. 5, 1989

[51] Int. Cl.[4] ..... F01M 1/06

[52] U.S. Cl. ..... 123/90.34; 123/196 W; 184/6.1

[58] Field of Search ..... 123/196 R, 196 W, 90.34, 123/90.36, 192 B; 184/6.1

[56] References Cited

U.S. PATENT DOCUMENTS

| | | | |
|---|---|---|---|
| 1,864,314 | 6/1932 | Morrill | 123/90.34 |
| 2,346,148 | 4/1944 | Bosma | 184/6.1 |
| 2,678,702 | 5/1954 | O'Harrow | 184/6.1 |
| 3,628,513 | 12/1971 | Grosseau | 123/90.34 |
| 3,875,908 | 4/1975 | Ayres | 123/90.36 |
| 3,958,541 | 5/1976 | Lachnit | 123/90.34 |
| 4,343,270 | 8/1982 | Kawabe | 123/90.34 |
| 4,768,397 | 9/1988 | Adams | 74/603 |

*Primary Examiner*—E. Rollins Cross

*Attorney, Agent, or Firm*—Albert L. Jeffers; John F. Hoffman

[57] ABSTRACT

The present invention is a lubrication system for an internal combustion engine. Lubricating oil flows through a central bore of a camshaft, and the camshaft sprays oil into a journal bearing. The crankshaft and camshaft are configured so that they are in phase, whenever the camshaft is closest to the camshaft during a rotation, the camshaft sprays oil into the journal bearing. Since the crankshaft has twice the rotational velocity of the camshaft, two spray holes are provided in the camshaft so that a spray hole supplies oil on each cycle of the crankshaft rotation.

21 Claims, 2 Drawing Sheets

PHASE TIMED CAMSHAFT SPRAY LUBRICATION SYSTEM

BACKGROUND OF THE INVENTION

The field of the invention is that of lubrication systems for internal combustion engines. More specifically, the field is that of phase timed lubrication systems for a crankshaft counterbalancing system.

In single cylinder horizontal or vertical air cooled engines, bearings are lubricated using a pressurized gallery system. The connecting rod is lubricated from the cylinder block bearing via a cross drilled oil passage within the crankshaft. The passage is drilled at a diagonal from the cylinder block crank main journal through the upper crank cheek and through the crank pin to provide a lubrication passage to the rod journal. The lubricant feed to the crank pin pressurizes the crank pin, and excess lubricant thrown off the rod bearing also lubricates the piston cylinder bore with the throw off of the excess oil from the rod journal. This system works for a completely pressurized bearing journal system and provides adequate lubrication for the internal parts of an engine.

Dealing with smaller engines, their crankshafts have a more limited space within the rotational plane of the crankcase, which limits the size and mass of the crankshaft counterweights. Counterweight designs have changed to accommodate smaller engines; rather than increase the mass of the counterweight, the mass of the opposing pin is reduced by drilling a balance hole through the center of the crank pin and crankshaft webs. However, the oil feed passage to the journal surface of the crank pin is interrupted by the cross drilled balance hole.

A lubrication system which presents one solution to the oil passage interruption problem is described in U.S. Pat. No. 4,768,397 (Adams). Adams describes using a tubular lubricant conduit to bridge the balance hole and re-establish the lubricant path. Yet, this system requires an additional operation in its manufacture, along with the additional tube component. Further, the tubular conduit is a source of potential problems due to the tube not being retained and migrating due to centrifugal force, which would interrupt the lubricant flow and cause the connecting rod bearing to score and fail.

Other methods use splash or general pressure spray lubrication within the crankcase to lubricate the connecting rod bearing and cylinder bore, but these methods are not as positive as pressure lubrication in the connecting rod bearing and bore area. For example, a gallery system used for lubricating the main shaft of an engine can have a cross-drilled aperture in the lubricant passage which allows oil to spray out continuously. The continuous spray sporadically lubricates the rod bearing, with the oil emitting from the upper portion of the cylinder in a direction generally perpendicular to the bearing's plane of rotation so that oil reaching the bearing is not guaranteed.

A spray system is described in U.S. Pat. No. 2,678,702 (O'Harrow). The lubrication system of O'Harrow has a camshaft with an axially located passage and a series of lateral passages. The axially located passage serves as a conduit for lubricating oil, while the lateral passages continuously spray lubricant oil. Connecting rods have apertures which allow oil to penetrate to journal positions. A recess is placed within each journal for containing sprayed oil. The aperture and spray are designed to be aligned at the point when the centrifugal force of maximum intensity between the shaft axis and the bearing axis is coincident with the centrifugal force at the journal surface within the recess. However, this point of coincidence is at the point of rotation where the journal is at its farthest point from the oil spray, so that less of the spray actually reaches the journal because of scatter. Also, the spray system of O'Harrow requires a significant amount of space within the crankcase which is not present in smaller engines. Further, the O'Harrow spray system does not account for the camshaft and the crankshaft rotating at different speeds.

Thus, an improved spray lubrication system for internal combustion engines is needed. Also needed is a system which effectively delivers sufficient amounts of oil both efficiently and economically. A further need exists for such a lubrication system which does not require additional components. Still another need involves an efficient lubrication system for shafts with different rotational speeds.

SUMMARY OF THE INVENTION

In the present invention, lubricating oil passes through a bore within a lubricating shaft, with some of the oil being sprayed onto an adjacent crankshaft. The lubricating shaft has a different rotational velocity than the crankshaft, so a plurality of spray outlets are provided on the lubricating shaft to spray lubrication on the bearing once every rotation of the driving shaft. The lubricating shaft is configured so that a spray outlet expels oil onto the bearing surface when the shafts are at their closest proximity during rotation.

The pressure lubrication system of the present invention, in one form thereof, comprises an oil pump as a source of pressurized oil. The pump draws oil from the engine sump and delivers pressurized oil to the main journal and camshaft journal on the cover side of the engine. The camshaft has an axial bore for transferring oil from the outer recess of the camshaft bearing through the center of the camshaft. The camshaft center bore serves as an oil passage connecting the sump to the cylinder block camshaft bearing and bearing recess, where oil is fed through another passage within the block to the cylinder main bearing.

The spray lubricant is discharged from a radial hole, the hole extending to the axis of the camshaft at the plane of rotation of the piston connecting rod center, so that each hole sprays into the connecting rod oil feed opening. This arrangement causes a stream of oil to spray into the oil feed opening when the opening is exposed and the shafts are at their closest proximity. The phase coordination of the camshaft compensates for the centrifugal lead of the speed of the camshaft, and the connecting rod feed opening is sufficiently wide to assure that a positive spray of oil is fed into the opening over the speed range of the engine.

To account for the camshaft rotating at half the speed of the crankshaft, two radial holes are located on opposite sides of the camshaft so that at every rotation of the crankshaft, one of the radial holes is positioned to spray lubrication on the bearing. The location and proximity of the rod and camshaft advantageously effect the phasing of the rotative cycle of the connecting rod bearing. With the arrangement of the present invention, oil spray is directed into the feed slot within the rod bearing on the low hydrodynamic pressure side of the journal. This manner of lubrication allows the oil to feed into the bearing with sufficient controlled quantity, allowing for a hydrodynamic pressure build up within the rod bearing. As the cam continues to rotate and the piston travels upward within the cylinder bore, the spray from the cam lubricates the bore and thrust surface within the cylinder with a positive film of oil.

The present invention is, in one aspect, an internal combustion engine comprising a crankcase having a lubricating shaft and a crankshaft rotatably disposed within, and an oil pump for circulating oil within the crankcase. The crankshaft has journal bearings having a feed opening on its surface. The lubricating shaft has an axial bore and oil spray outlet configured so that at the portion of rotation when the shafts are closest together, an oil outlet faces the feed opening to spray oil into the feed opening to lubricate the bearing surface.

The present invention is, in another aspect, an internal combustion engine comprising a crankcase having a crankshaft and a camshaft rotatably disposed within. Also, an oil pump is connected to an oil sump for circulating oil within the crankcase. Piston connecting rods are attached to the crankshaft by bearing portions, with the bearings having a feed opening on part of the bearing surface. The camshaft has an axial bore and a plurality of spray outlets which are in communication with the oil pump, so oil is pumped into the bore and is expelled through the spray outlets. The shafts are configured so that during the portion of every rotation when the shafts are closest together, a spray outlet is facing the feed opening to lubricate the journal bearing surface.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
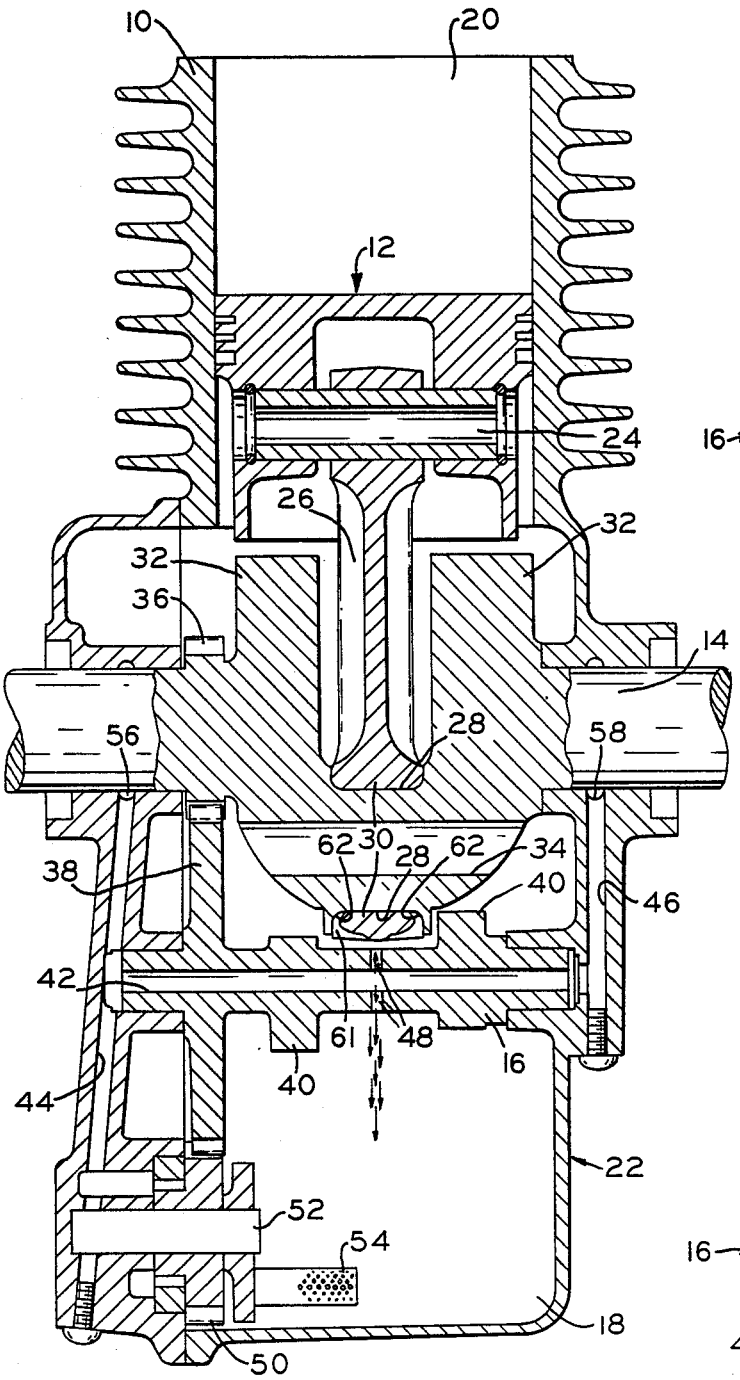
FIG. 1 is a sectional view of an engine having a spray lubrication system of the present invention.

Corresponding reference characters indicate corresponding parts throughout the several views. The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

The phase timed camshaft spray lubrication system is shown in FIG. 1. Disposed within crankcase 10 is a piston 12, a crankshaft 14, a camshaft 16, and an oil sump 18. Crankcase 10 defines a piston chamber 20 within which piston 12 moves, and an oil gallery system 22. Wrist pin 24 is rotatably disposed within piston 12, and is pivotally attached to connecting rod 26 which couples piston 12 to crankshaft 14.

Crankshaft 14 is rotatably disposed within crankcase 10 and has a journal portion 28 which is attached to bearing portion 30 of connecting rod 26. Disposed on both sides of journal portion 28 on crankshaft 14 are counterweights 32. A cross drilled crank pin balance hole 34 extends through journal portion 28 to further lighten the portion of crankshaft 14 opposite counterweights 32. Also disposed on crankshaft 14 is a crankshaft gear 36, which is operably engaged with camshaft gear 38. The gear ratio between gears 36 and 38 provide for crankshaft 14 to have a rotational velocity twice that of camshaft 16.

Camshaft 16 is also rotatably disposed within crankcase 10, having an axis generally parallel to the axis of crankshaft 14. Outwardly disposed on camshaft 16 are cams 40, with camshaft 16 having a centrally located axial bore 42 which is in communication with oil passages 44 and 46 of crankcase 10. Also, two spray outlets 48 are disposed within camshaft 16 and have a plane of rotation generally coplanar to the plane defined by the rotation of bearing 30, transverse to axial bore 42. In the preferred embodiment, spray outlets 48 are holes having a diameter of approximately 0.03 millimeters (mm) and are cross drilled in the plane of rotation of the axial mid-point of bearing portion 30 of connecting rod 26.

Oil sump region 18 is located near the bottom of crankcase 10, with pump gear 50 of oil pump 52 disposed within. A suction inlet 54 is disposed near the bottom of oil sump region 18, and is in communication with oil passage 44. Oil gallery system 22 of crankcase 10 includes oil pump 52, oil passages 44 and 46, axial bore 42, spray outlets 48, and oil galleries 56 and 58. Oil passageways 44 and 46 are connected to oil galleries 56 and 58, which are circumferential cavities which surround crankshaft 14. Oil passage 44 directly supplies oil to oil gallery 56, while oil passage 46 receives oil via oil passage 44 and axial bore 52 and supplies oil to oil gallery 58.

Figure 2:
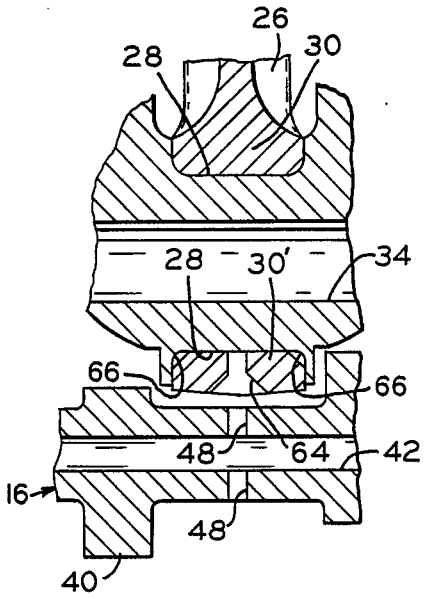
FIG. 2 is an enlarged sectional view of the journal bearing and camshaft with a chamfered hole in the bearing.
Figure 3:
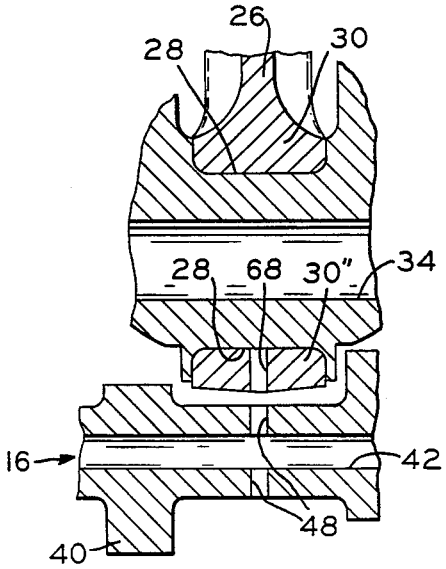
FIG. 3 is an enlarged sectional view of the journal bearing and camshaft with a milled slot in the bearing.
Figure 4:
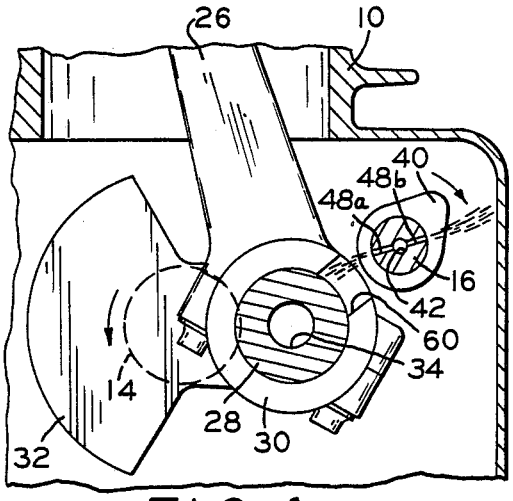
FIGS. 4–9 are transverse sectional views of the crankshaft and camshaft of the present invention taken over two rotations of the crankshaft.

As can be seen in FIG. 4, bearing 30 has a feed opening region 60 which can be in the form of a slot arranged to face camshaft 16. Three different contours for the feed opening 60 are shown in FIGS. 1–3. The spray outlets 48 provide lubrication to journal portion 28 by spraying oil into openings on bearing portion 30. Thus, the communication of oil from spray outlets 48 to the feed opening is periodically accomplished.

In FIG. 1, bearing portion 30 located in feed channel 61 is not as wide as feed channel 61 and has a wedged portion to divert the sprayed oil about the rounded ends of bearing portion 30. This configuration causes the oil to flow into tapered side slots 62 of opening 60, where the oil is contained to lubricate journal portion 28.

A second configuration for feed opening 60 is shown in FIG. 2, with bearing portion 30' having a chamfered hole 64 located in the middle thereof. In addition, the inner corners of bearing portion 30' are chamfered to provide side reservoirs 66. The chamfer of hole 64 provides a wider initial opening for oil, and excess oil within the bearing can accumulate within the side reservoirs 66.

A third configuration for feed opening region 60 of bearing 30'' is depicted in FIG. 3, having milled slot 68 located approximately in the middle of bearing portion 30''. An advantage of this configuration is that bearing portion 30'' can made from standard molds, with an additional operation of milling slot 68 within bearing portion 30'' being the only additional step or component needed.

In operation, suction inlet 54 provides an intake for pump gear 50 to provide pressurized oil within oil passage 44. The pressurized oil travels both to oil gallery 56 and enters axial bore 42 of camshaft 16. At approximately the middle of camshaft 16, some of the oil exits the axial bore through spray outlets 48. The remainder of the oil continues to flow through camshaft 16 to oil passage 46, which eventually connects to oil gallery 58. Thus, pump 52 circulates oil within crankcase 10 to lubricate both crankshaft 14 and journal 28.

Figure 5:
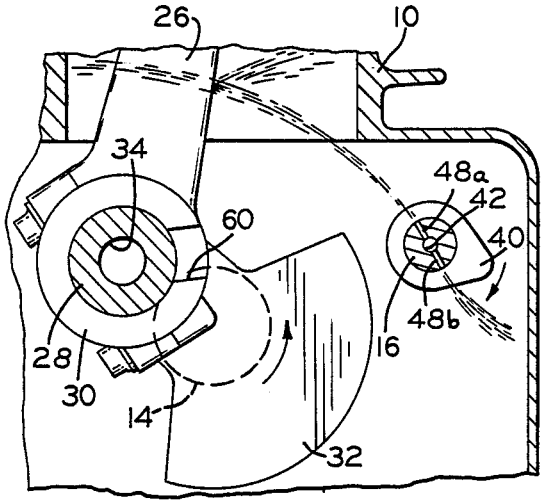
Figure 6:
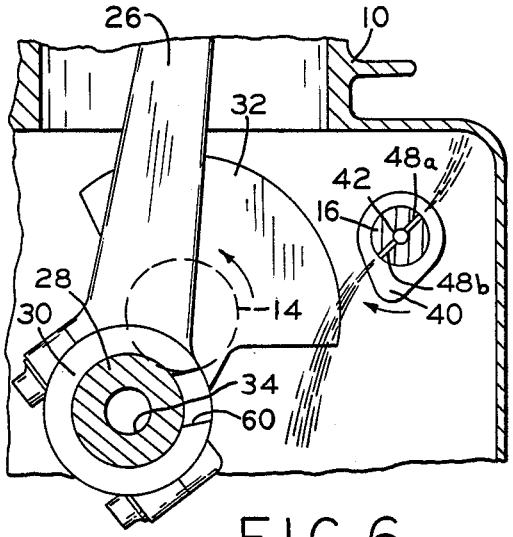
Figure 7:
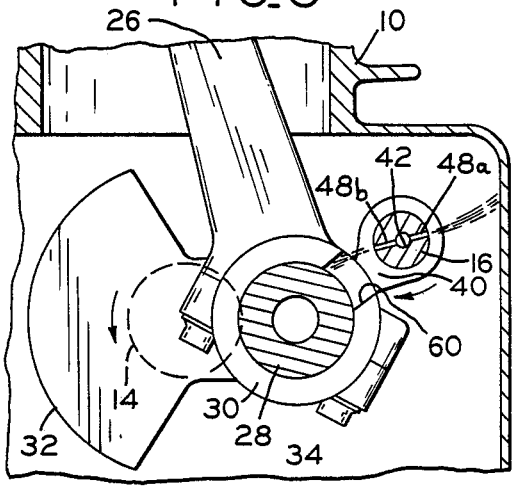
Figure 8:
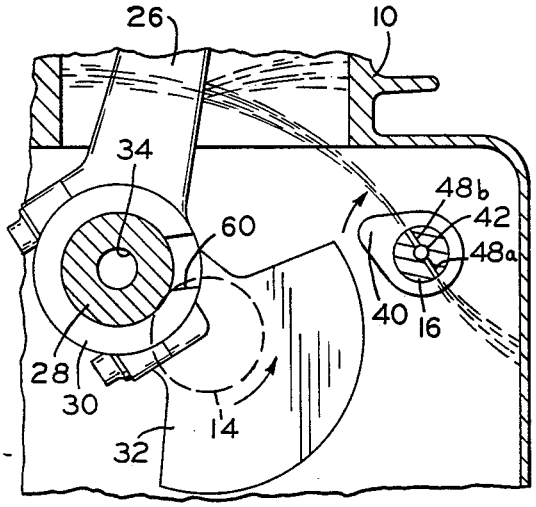
Figure 9:
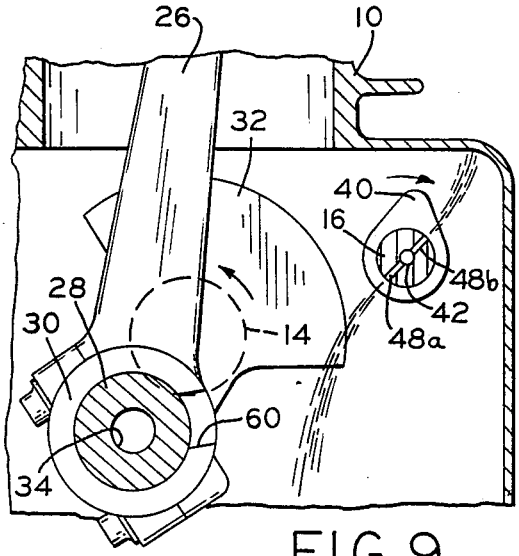

The operation of the phase timed spray lubrication system is shown in FIGS. 4–9. In FIG. 4, bearing portion 30 and camshaft 16 are at their closest proximity. At this point in the rotation of the crankshaft 14, spray outlet 48*a* faces feed slot 60 to spray oil onto the surface of journal 28. Because the oil requires time to travel to the feed opening, the alignment of the feed opening 10 and spray outlet 48 is offset to take this spraying lag into account. FIG. 5 shows the arrangement within the crankcase one third of a rotation later. Camshaft 16 has rotated so that neither spray outlet 48*a* nor 48*b* is directly spraying oil onto feed opening 60 of bearing portion 30. This remains the case in FIG. 6 where camshaft 16 has further rotated bringing a second spray outlet 48*b* into closer alignment with feed opening 60 of bearing portion 30. After the completion of a full rotation, the arrangement of FIG. 7 occurs. In FIG. 7, spray outlet 48*b* faces feed opening 60 of bearing portion 30, to spray oil upon journal portion 28. One third of a rotation after the position of FIG. 7, FIG. 8 shows spray outlets 48*a* and 48*b* spraying different parts of crankcase 10. Next at the position shown in FIG. 9, approximately 120° rotation past the position of FIG. 8, the first spray outlet 48*a* begins to align with feed slot 60 although the oil spray does not yet contact feed slot 60. After another third of a rotation, (FIG. 9) becomes the arrangement shown in FIG. 4. Thus, the preferred embodiment comprises a two-phase lubrication system.

The position of the spray outlets 48 should normally lead the oil spray so that when the shafts are closest, the oil sprays into the feed opening.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and fall within the limits of the appended claims.

I claim:

1. An internal combustion engine comprising:

a crankcase;

a crankshaft rotatably disposed within said crankcase;

a connecting rod having a bearing portion connected to a journal portion of said crankshaft, said bearing portion having a lubrication feed opening allowing oil to lubricate journal bearing surfaces of said crankshaft and said connecting rod;

a lubricating shaft rotatably disposed within said crankcase, said lubricating shaft having an axial bore and a spray means connected to said bore for spraying oil on said crankshaft; and an oil pump means in communication with said bore for supplying pressurized lubricating oil to said bore;

said shafts configured such that during a portion of the rotation of said crankshaft when said shafts are closest in position, said spray means of said lubricating shaft is positioned facing said feed opening and oil is sprayed into said feed opening to lubricate the journal bearing surfaces.

2. The engine of claim 1 wherein said spray means comprises spray outlets in said lubricating shaft located transversely in relation to said bore.

3. The engine of claim 2 wherein said spray outlets comprise holes having a diameter of approximately 0.03 mm.

4. The engine of claim 1 wherein said connecting rod bearing portion has a width less than the journal of said crankshaft to form a plurality of said feed openings.

5. The lubrication system of claim 1 wherein said feed opening comprises a centrally located chamfered hole in said bearing portion for receiving oil.

6. The lubrication system of claim 5 wherein said bearing portion has chamfered corners, said chamfered corners defining oil reservoirs.

7. The lubrication system of claim 4 wherein said feed opening comprises a slot, said slot aligned with and facing the plane of rotation of said spray means.

8. An internal combustion engine comprising:

a crankcase;

a piston;

a crankshaft rotatably disposed within said crankcase, said crankshaft having at least one journal portion;

at least one connecting rod, said rod connected to said crankshaft at said journal portion by a bearing portion, said bearing portion having a feed opening for providing lubrication to journal bearing surfaces of said crankshaft and said connecting rod;

an oil pump connected to an oil sump for supplying lubricating oil within said engine; and a camshaft rotatably disposed in said crankcase and coupled to said oil pump, said camshaft having an axial bore and a spray means, said axial bore and said spray means in communication with said oil pump such that oil flows through said bore and is expelled through said spray means;

said journal bearing and said spray means configured such that on every rotation of said crankshaft, during the period when said journal bearing is closest to said camshaft, said spray means faces said feed opening and expels a stream of oil into said feed opening to lubricate said journal bearing surface.

9. The engine of claim 8 wherein said crankshaft has a rotational velocity which is twice the rotational velocity of said lubrication shaft.

10. The engine of claim 9 wherein said crankshaft has gears meshing with gears of said lubrication shaft and the gear ratio between said shafts causes said crankshaft to have a rotational velocity twice the rotational velocity of said lubrication shaft.

11. The engine of claim 8 wherein said spray means comprises spray holes in said camshaft located transversely in relation to said bore.

12. The engine of claim 11 wherein said spray holes have a diameter of approximately 0.03 mm.

13. The engine of claim 8 wherein said connecting rod bearing portion has a width less than the journal of said crankshaft to form a plurality of said feed openings.

14. The engine of claim 8 wherein said feed opening of said bearing portion comprises a centrally located chamfered hole for receiving oil.

15. The engine of claim 14 wherein said bearing portion has chamfered corners, said chamfered corners defining oil reservoirs.

16. The engine of claim 11 wherein said feed opening comprises a slot, said slot aligned with and facing the plane of rotation of said spray means.

17. An internal combustion engine comprising:

a crankcase;

a crankshaft rotatably disposed within said crankcase, said crankshaft having a journal portion;

a connecting rod, said rod connected to said crankshaft at said journal portion by a bearing portion, said bearing portion having a feed opening for providing lubrication to journal bearing surfaces of said crankshaft and said connecting rod;

an oil pump connected to an oil sump region for circulating lubricating oil within said engine; and a camshaft rotatably disposed within said crankcase and coupled to said oil pump, said camshaft having an axial bore and a plurality of spray holes, said spray holes positioned transverse to said bore, said axial bore and said spray holes in communication with said oil pump such that oil flows through said bore and is expelled through said spray holes;

said bearing portion and said spray means configured such that on every rotation of said crankshaft, during the period when said bearing portion is closest to said camshaft, at least one of said spray holes faces said feed opening and expels a stream of oil into said feed opening to lubricate said journal bearing surface.

18. The engine of claim 17 wherein said connecting rod bearing portion has a width less than the journal of said crankshaft to form a plurality of said feed openings.

19. The engine of claim 17 wherein said feed opening comprises a centrally located chamfered hole in said bearing portion for receiving oil.

20. The engine of claim 19 wherein said bearing portion has chamfered corners, said chamfered corners defining oil reservoirs.

21. The engine of claim 17 wherein said feed opening comprises a slot, said slot aligned with and facing the plane of rotation of said spray holes.

* * * * *